US007154361B2

(12) United States Patent
Babu et al.

(10) Patent No.: US 7,154,361 B2
(45) Date of Patent: Dec. 26, 2006

(54) ACCESSORIES FOR A ROTATABLE LATCHING SHAFT OF A CIRCUIT BREAKER

(75) Inventors: Triplicane Gopikrishnan Babu, Chennai (IN); Sapuram Sudhakar, Bangalore (IN); Dileep Mangsuli, Karnataka (IN); Jeffrey Anthony Hughes, St. Helens (GB)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/908,246

(22) Filed: May 4, 2005
(Under 37 CFR 1.47)

(65) Prior Publication Data

US 2006/0250200 A1 Nov. 9, 2006

(51) Int. Cl.
*H01H 9/00* (2006.01)
*H01H 9/20* (2006.01)

(52) U.S. Cl. ..... 335/6; 335/21; 335/165; 335/172; 335/175

(58) Field of Classification Search ..... 335/165–176, 335/132, 202, 6, 8–10, 13, 17, 21
See application file for complete search history.

(56) References Cited

U.S. PATENT DOCUMENTS

| | | | | |
|---|---|---|---|---|
| 6,188,302 | B1 * | 2/2001 | Conway | 335/202 |
| 6,208,228 | B1 * | 3/2001 | Gula et al. | 335/172 |
| 6,353,377 | B1 * | 3/2002 | Palmer | 335/172 |
| 6,445,274 | B1 * | 9/2002 | Malingowski et al. | 337/49 |
| 6,768,404 | B1 * | 7/2004 | Ojeda et al. | 335/175 |

* cited by examiner

*Primary Examiner*—Ramon M. Barrera
(74) *Attorney, Agent, or Firm*—Cantor Colburn LLP

(57) ABSTRACT

An accessory for providing mechanical communication between a rotatable latching shaft and an actuation device of an electrical circuit breaker includes a lever, a working surface, and a snap fitting. The lever includes an engagement orifice. The engagement orifice is receptive to the rotatable latching shaft. The working surface is in mechanical communication with the actuation device. The snap fitting is securely mated with the rotatable latching shaft.

14 Claims, 7 Drawing Sheets

ACCESSORIES FOR A ROTATABLE LATCHING SHAFT OF A CIRCUIT BREAKER

BACKGROUND OF THE INVENTION

The present invention relates to an accessory for an air circuit breaker. An accessory is typically designed to fit onto a latching shaft included in the circuit breaker. The accessory is often used to provide communication between a latching shaft and an actuation device within the circuit breaker.

Air circuit breakers are commonly used in electrical distribution systems. A typical air circuit breaker comprises a component for connecting an electrical power source to electrical power consumer called a load. The component is referred to as a main contact assembly. A main contact is typically either opened, interrupting a path for power to travel from the source to the load, or closed, providing a path for power to travel from the source to the load. In many air circuit breakers, the force necessary to open or close the main contact assembly is provided by an arrangement of compression springs. When the compression springs discharge, they exert a force that provides the energy needed to open or close the main contacts. Compression springs that provide a force to close the main contacts are often called closing springs. Compression springs that provide a force to open the main contacts are often referred to as contact springs.

In many air circuit breakers, the mechanism for controlling the compression springs comprises a configuration of mechanical linkages between a latching shaft and an actuation device. The actuation device may be manually or electrically operated. An electrically operated actuation device generally operates when a particular electrical condition is sensed, for example, under voltage or remote operation of breaker for closing and opening conditions. The actuation device within the circuit breaker typically imparts a force onto an accessory. The accessory then translates the force from the actuation device into a rotational force exerted on the latching shaft. The latching shaft then rotates. This rotation is translated through the mechanical linkages to unlatch or activate either the closing springs or the contact springs. There is typically a first latching shaft mechanically linked to the closing springs called the closing shaft. A second latching shaft is mechanically linked to the contact springs called the tripping shaft.

As each actuation device acts upon the latching shaft via a corresponding accessory, the accessory acts as a lever converting a linear force from the actuation device to a rotational force on the latching shaft. The accessory is disposed in contact with the latching shaft and attached to the latching shaft by a fixing mechanism. A common fixing mechanism typically includes a threaded fastener, a rivet joint or a pin assembly. Additionally, the fixing mechanism is normally metallic. Thus, a typical fixing mechanism requires selective local heat treatment of the latching shaft, tapping of the latching shaft and the accessory, riveting, or a pin assembly. These processes add to the cost and time of production. Additionally, the fixing mechanism tends to loosen over time.

Thus, it is desirable to reduce the time and cost of production by developing a fixing mechanism that eliminates metallic threaded fasteners, rivet joints and pin assemblies. Eliminating metallic threaded fasteners, rivet joints and pin assembly fixing mechanisms may also prevent loosening of fixing mechanisms over time.

BRIEF DESCRIPTION OF THE INVENTION

Exemplary embodiments of the invention include an accessory for providing mechanical communication between a rotatable latching shaft and an actuation device of an electrical circuit breaker. The accessory includes a lever, a working surface, and a snap fitting. The lever includes an engagement orifice. The engagement orifice is receptive to the rotatable latching shaft. The working surface is in mechanical communication with the actuation device. The snap fitting is securely mated with the rotatable latching shaft.

Further exemplary embodiments of the invention include an accessorized shaft in mechanical communication with an actuation device of a circuit breaker. The accessorized shaft includes a rotatable latching shaft and an accessory. The accessory includes a lever, a working surface, and a snap fitting. The lever includes an engagement orifice. The engagement orifice is receptive to the rotatable latching shaft. The working surface is in mechanical communication with the actuation device. The snap fitting is securely mated with the rotatable latching shaft.

Further exemplary embodiments of the invention include a mechanism that operates a main contact assembly of a circuit breaker via mechanical communication between the mechanism and a spring. The mechanism includes an actuation device, a rotatable latching shaft, a mechanical linkage, and an accessory. The mechanical linkage provides the mechanical communication between the rotatable latching shaft and the spring. The accessory includes a lever, a working surface, and a snap fitting. The lever includes an engagement orifice. The engagement orifice is receptive to the rotatable latching shaft. The working surface is in mechanical communication with the actuation device. The snap fitting is securely mated with the rotatable latching shaft.

The above, and other objects, features and advantages of the present invention will become apparent from the following description read in conjunction with the accompanying drawings, in which like reference numerals designate the same elements.

BRIEF DESCRIPTION OF THE DRAWINGS

Referring now to the drawings wherein like elements are numbered alike in the several FIGURES.

DETAILED DESCRIPTION OF THE INVENTION

An embodiment of the present invention is an air circuit breaker. However, it is contemplated that the method and apparatus described may be implemented in other electrical circuit breakers. Additionally, the method and apparatus described are suited to use in either more complex or simpler designs involving accessories than those discussed with respect to the exemplary circuit breaker below.

Figure 1:
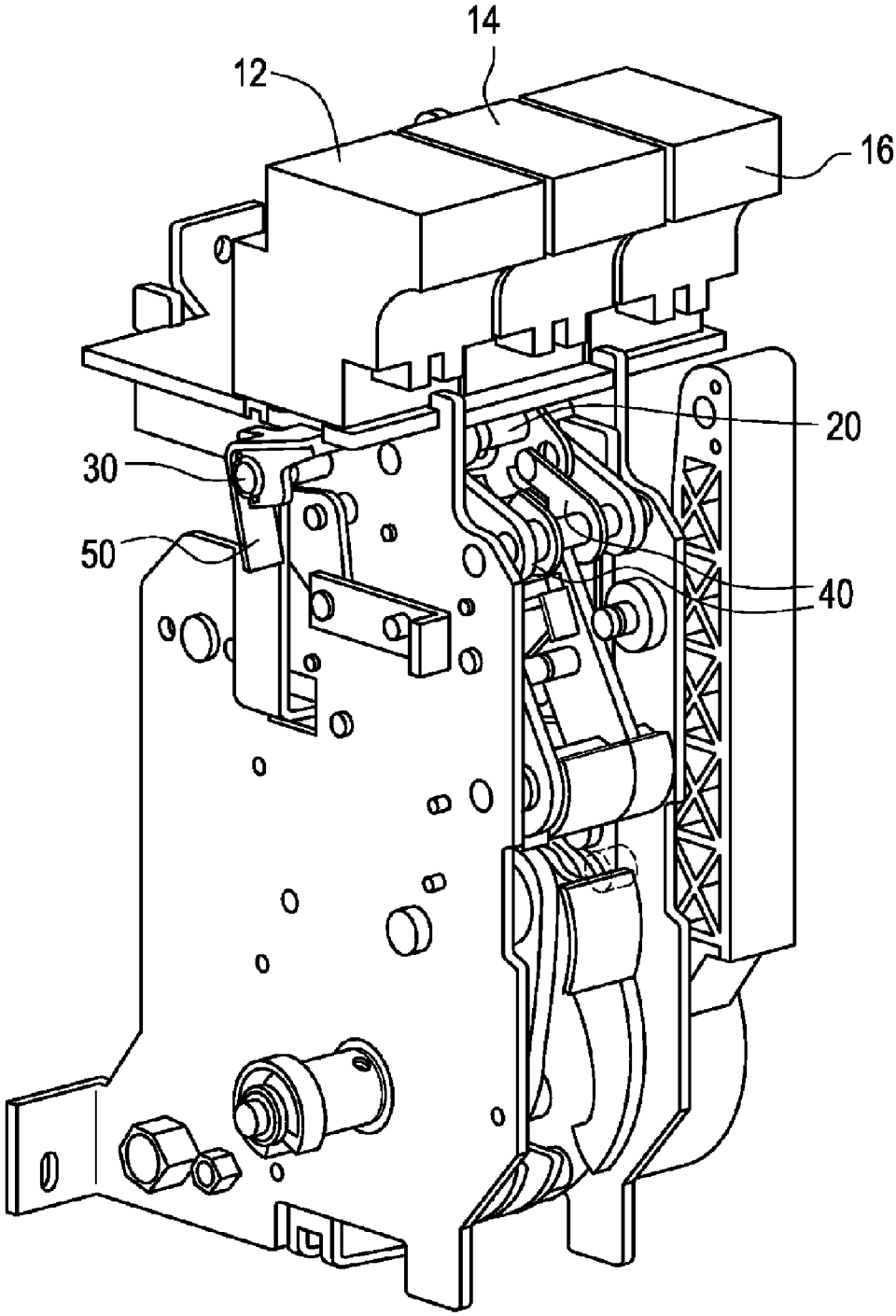
FIG. 1 is an aspect view of an exemplary embodiment of a circuit breaker having accessories and a closing shaft and a tripping shaft.

FIG. 1 is an aspect view of an exemplary circuit breaker 10 having an accessory and a rotatable latching shaft. The rotatable latching shaft includes either a closing shaft 20 or a tripping shaft 30. Closing and tripping shafts 20 and 30 are mechanically communicated to compression springs (not shown) via mechanical linkages 40. Compression springs include a closing springs and a contact springs. Mechanical linkages 40 allow a rotation of the closing shaft 20 to release the energy stored in closing springs to shut or close a main contact assembly (not shown). When the main contact assembly is closed, electrical power passes from an electrical source (not shown) upstream of the circuit breaker 10 to an electrical load (not shown) downstream of the circuit breaker 10. Mechanical linkages 40 also allow rotation of the tripping shaft 30 to release the energy stored in contact springs to open the main contact assembly. When the main contact assembly is opened, electrical power is interrupted from an electrical source upstream of the circuit breaker 10 to an electrical load downstream of the circuit breaker 10.

Circuit breaker 10 includes an actuation device. The actuation device typically responds to an electrical control input or a mechanical control input. Examples of the actuation device include but are not limited to a shunt coil 12, a closing coil 14, and an undervoltage coil 16, a trip free assembly (not shown), a trip coil (not shown), a racking interlock (not shown), and a manual device (not shown). In an exemplary embodiment shunt coil 12, closing coil 14, and undervoltage coil 16 are mounted on a top portion of the circuit breaker 10. The shunt coil 12 is actuated by an electrical input signal. When actuated, shunt coil 12 outputs a linear mechanical force that is capable of translation to the tripping shaft 30. The closing coil 14 is also actuated by an electrical input signal. When actuated, closing coil 14 outputs a linear mechanical force in a direction shown by arrow 19 that is capable of translation to the closing shaft 20. Although an exemplary embodiment discloses the actuation device imparting a linear mechanical force on the accessory, other methods of imparting a force are also contemplated. The undervoltage coil 16 is actuated by a low voltage condition of the electrical source. When actuated, undervoltage coil 16 outputs a linear mechanical force in a direction shown by arrow 19 direction that is capable of translation to the tripping shaft 30. An accessory 50 is a typical component used to translate linear mechanical forces into rotational forces. As referred to in FIG. 1, the accessory 50 refers generally to any accessory. In an exemplary embodiment, accessory 50 includes for example a first tripping accessory 51, a second tripping accessory 52, a third tripping accessory 54, a first closing accessory 56, or a second closing accessory 58. The accessory 50 acts as a lever to translate linear mechanical forces into rotational forces. The accessory 50 may also be used for other functions involving control and use of the circuit breaker. The accessory 50 is disposed at the closing or tripping shaft 20 or 30 and fixably secured to the closing or tripping shaft 20 or 30. The accessory 50 is also disposed such that a working surface of the accessory 50 is in communication with the actuation device. In an exemplary embodiment, each accessory 50 is made of molded plastic.

Figure 2:
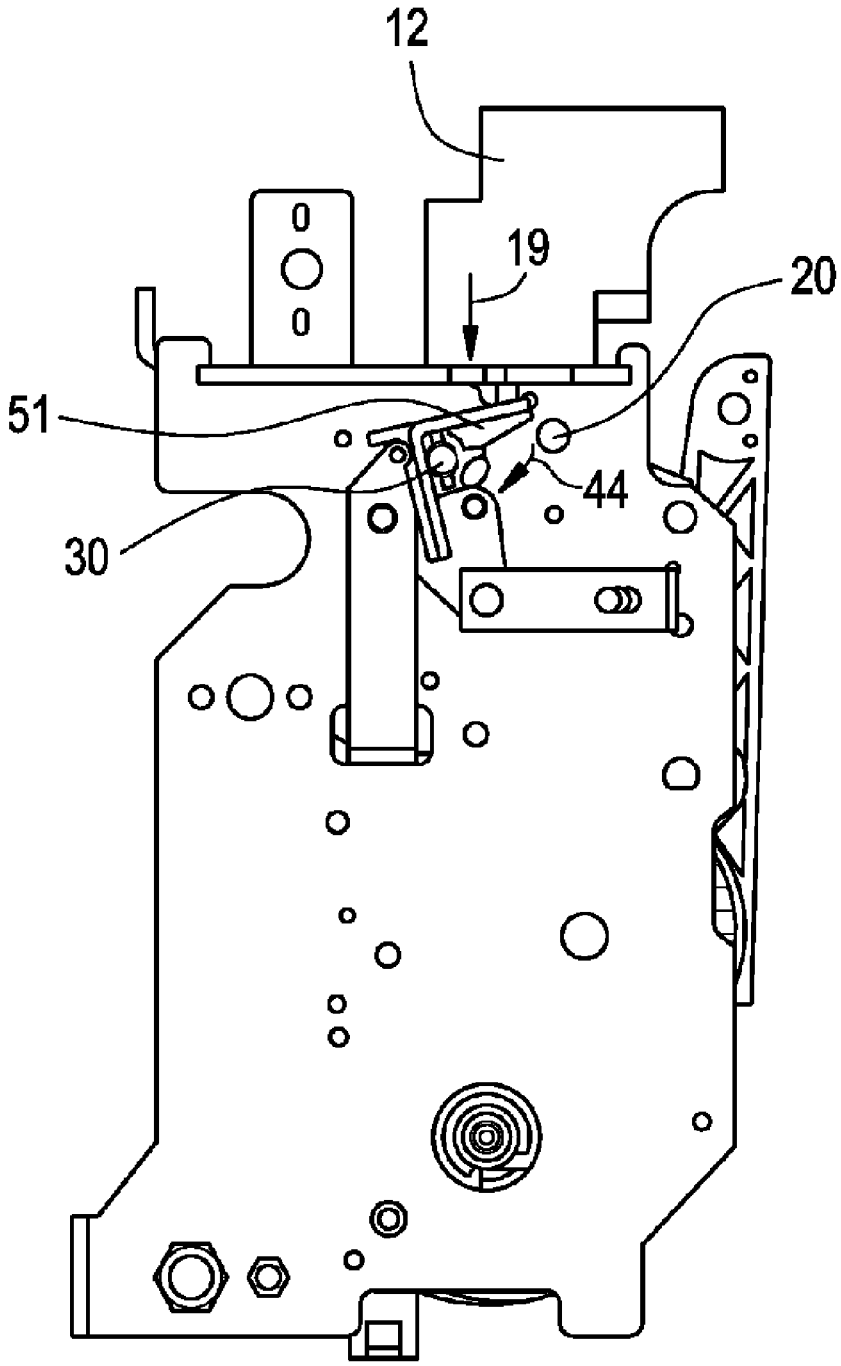
FIG. 2 is a side view of a the exemplary embodiment of a circuit breaker of FIG. 1 showing a shunt coil in communication with a first tripping accessory.

FIG. 2 shows a side view of circuit breaker 10 in an exemplary embodiment. Shunt coil 12 is shown in communication with a first tripping accessory 51. First tripping accessory 51 is also fixably secured to the tripping shaft 30. When shunt coil 12 actuates, a linear force in a direction shown by arrow 19 is exerted on first tripping accessory 51 and translated into rotational force on tripping shaft 30 causing tripping shaft 30 to rotate in a direction shown by arrow 44. Rotation of the tripping shaft 30 causes the mechanical linkages 40 to release energy in the contact springs to open the main contact assembly.

Figure 3:
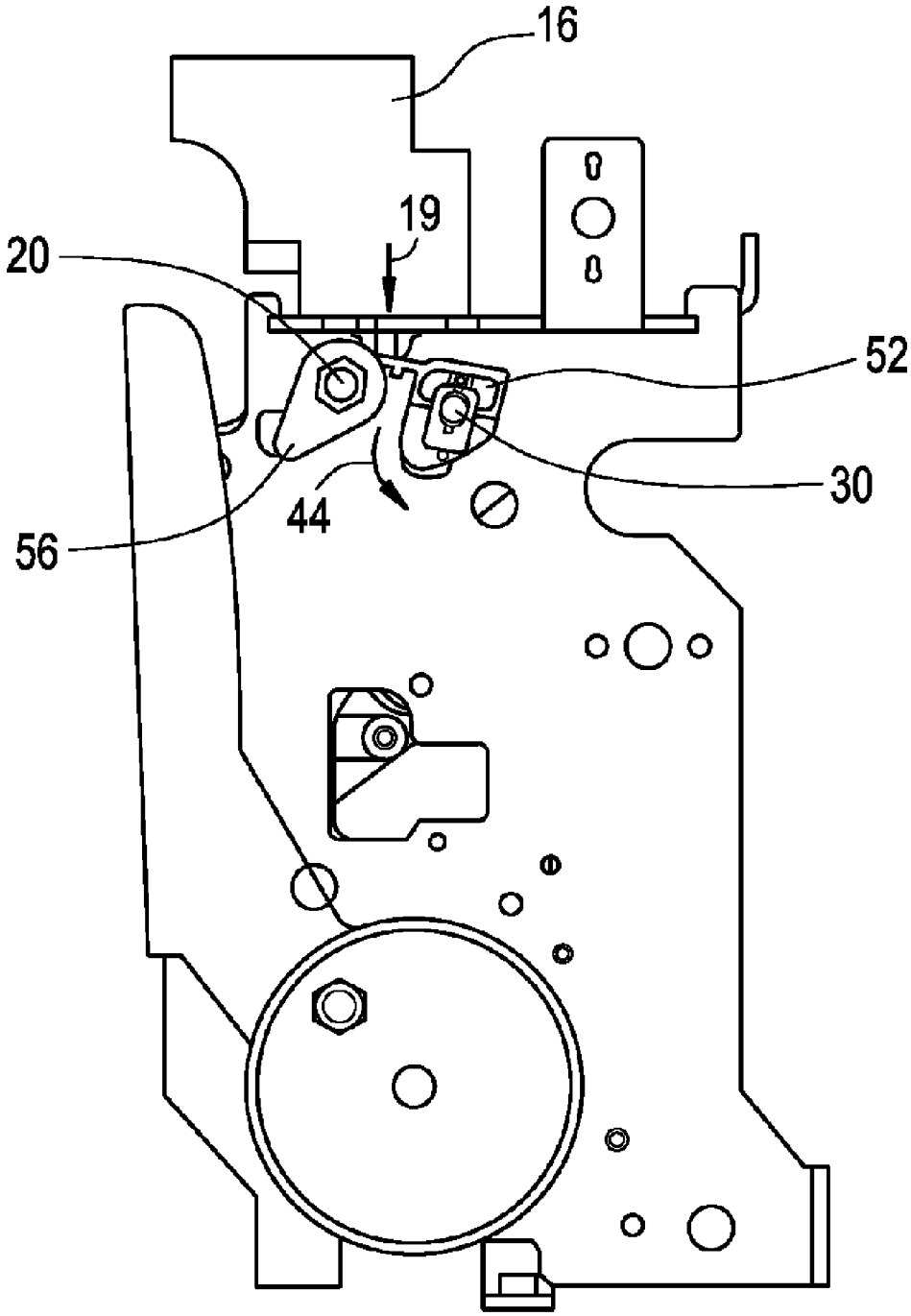
FIG. 3 is a side view showing the opposite side of the exemplary embodiment of a circuit breaker in FIG. 1 showing an undervoltage coil in communication with a second tripping accessory.

FIG. 3 shows an opposite side view of circuit breaker 10 in an exemplary embodiment. Undervoltage coil 16 is shown in communication with a second tripping accessory 52. Second tripping accessory 52 is also fixably secured to the tripping shaft 30. When undervoltage coil 16 actuates, a linear force in a direction shown by arrow 19 is exerted on second tripping accessory 52 and translated into rotational force on tripping shaft 30 causing tripping shaft 30 to rotate in a direction shown by arrow 44. Rotation of the tripping shaft 30 causes mechanical linkages 40 to release energy in the contact springs to open the main contact assembly. FIG. 3 also shows a first closing accessory 56. First closing accessory 56 is fixably secured to closing shaft 20.

Figure 4:
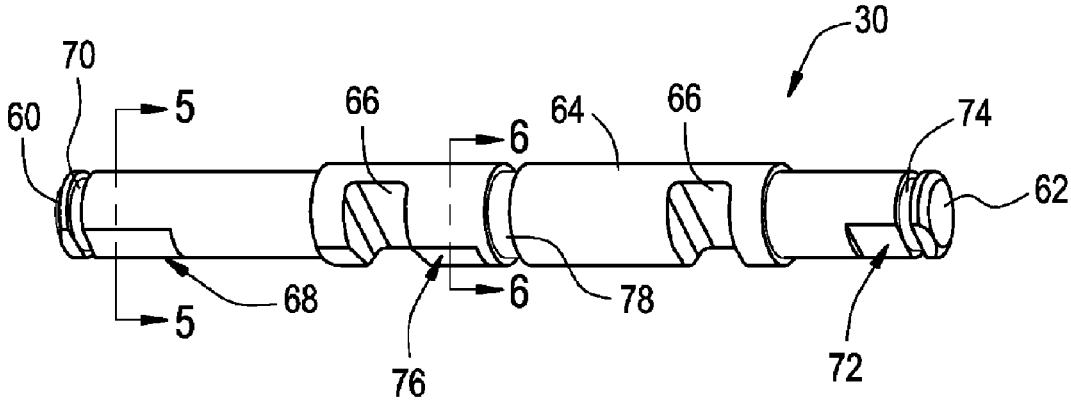
FIG. 4 is a perspective view of a tripping shaft from an exemplary embodiment.
Figure 5:
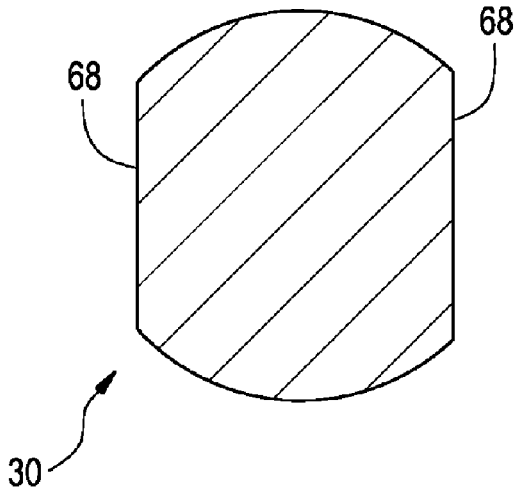
FIG. 5 is a cross section view of first flat surfaces of a tripping shaft from an exemplary embodiment showing a section cut with background removed.
Figure 6:
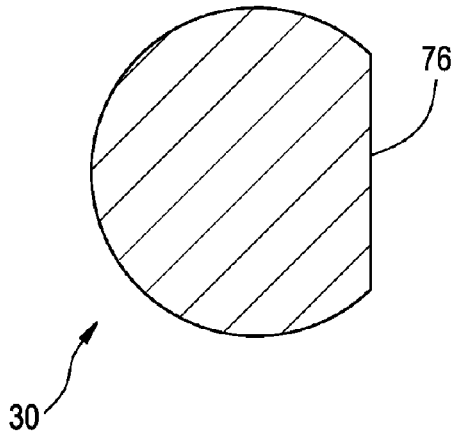
FIG. 6 is a cross section view of a third flat surface of a tripping shaft from an exemplary embodiment showing a section cut with background removed.

FIG. 4 shows the tripping shaft 30 in an exemplary embodiment. The tripping shaft 30 is substantially cylindrical in shape. Although the tripping shaft 30 of the exemplary embodiment shown is substantially cylindrical, other shapes are also contemplated. Tripping shaft 30 includes a first end 60 and a second end 62. A diameter of the tripping shaft 30 is substantially constant near both first and second ends 60 and 62. Near a center of the tripping shaft 30 a raised portion 64 has a larger diameter than the diameter at first and second ends 60 and 62. Raised portion 64 includes two notches 66 that provide for mechanical communication to mechanical linkages 40 to translate an unlatching force to the contact springs. First end 60 has a first flat surfaces 68 disposed on opposing sides of the tripping shaft 30. FIG. 5 shows a cross section of the tripping shaft 30 taken at the first flat surfaces. There is also a first groove 70 disposed near the first end 60. First groove 70 extends over a circumference of the tripping shaft 30. Second end 62 also has a second flat surfaces 72 disposed on opposing sides of the tripping shaft 30. Second flat surfaces 72 form a plane substantially parallel to a plane formed by first flat surfaces 68. A cross section of the tripping shaft 30 taken at the second flat surfaces 72 is identical to that shown in FIG. 5. A second groove 74 is disposed near the second end 62. Second groove 74 extends over the circumference of the tripping shaft 30. Raised portion 64 includes a third flat surface 76 which forms a plane substantially parallel to a plane formed by first and second flat surfaces 68 and 72. FIG. 6 shows a cross section of the tripping shaft 30 taken at the third flat surface. Raised portion 64 also includes a third groove 78. Third groove 78 extends over the circumference of the tripping shaft 30. In an exemplary embodiment, first, second and third flat surfaces 68, 72 and 76 and first, second and third grooves 70, 74 and 78 are formed by machining of the tripping shaft 30, however, it is envisioned that other methods including but not limited to die casting and molding could be used.

Figure 7:
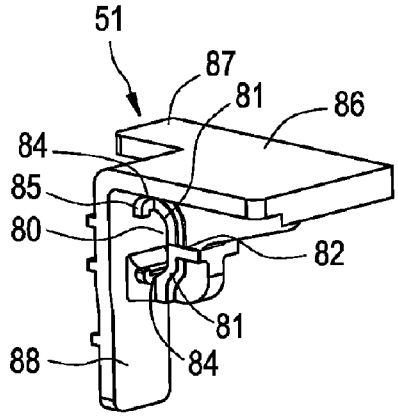
FIG. 7 is a perspective view of a first tripping accessory from an exemplary embodiment.

FIG. 7 shows a perspective view of the first tripping accessory 51 in an exemplary embodiment. First tripping accessory 51 is a lever that includes an engaging orifice 80. Engaging orifice 80 is a tubular cuff formed to match a shape of the tripping shaft 30 at the first end 60. Although a tubular cuff is used in an exemplary embodiment, it is contemplated that the engaging orifice could take on other forms of a hole in the lever. Engaging orifice 80 includes substantially circular portions 81 and flat portions 82. Circular portions 81 are disposed on opposing sides of the engaging orifice 80. Flat portions 82 are also disposed on opposing sides of the engaging orifice 80 to contact first flat surfaces 68 when the first tripping accessory 51 is fixably secured to the tripping shaft 30. Snap protrusions 84 extend from the engaging orifice in a direction substantially perpendicular to a diameter of the engaging orifice 80. Snap protrusions 84 include one protrusion from each of the circular portions 81 of the engaging orifice 80. Thus, the snap protrusions 84 are disposed on opposite sides of the engaging orifice 80. Snap protrusions 84 include a detent 85 at an end of each protrusion. The detent 85 engages the first groove 70. First flat surfaces 68 in contact with flat portions 82 prevent a rotation of the first tripping accessory 51 with respect to the surface of the tripping shaft 30. First tripping accessory 51 also includes an L bracket assembly formed by a first operating surface 86 and a second operating surface 88. First and second operating surfaces 86 and 88 are planar surfaces disposed substantially perpendicular to each other. First and second operating surfaces 86 and 88 are also disposed such that the planar surfaces of first and second operating surfaces 86 and 88 lie substantially perpendicular to the diameter of the engaging orifice 80. A tail piece 87 extends from the first operating surface substantially perpendicular to the second operating surface 88. Thus, tail piece 87 and first operating surface 86 form a T shape with the second operating surface 88 being the base of the T. First operating surface 86 is in communication with the shunt coil 12. Tail piece 87 is in communication with the racking interlock (not shown). Second operating surface 88 is in communication with the trip coil (not shown). The trip coil causes a rotation of the tripping shaft when a certain electrical fault condition is detected.

Figure 8:
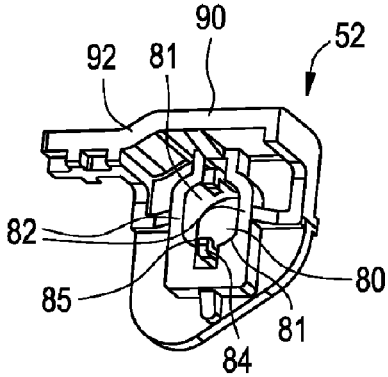
FIG. 8 is a perspective view of a second tripping accessory from an exemplary embodiment.

FIG. 8 shows a view of the second tripping accessory 52 in an exemplary embodiment. Second tripping accessory 52 includes an engaging orifice 80. Engaging orifice 80 is a tubular cuff formed to match a shape of the tripping shaft 30 at the second end 62. Thus, engaging orifice 80 includes substantially circular portions 81 and also includes flat portions 82. Circular portions 81 are disposed on opposing sides of the engaging orifice 80. Flat portions 82 are also disposed on opposing sides of the engaging orifice 80 to contact second flat surfaces 72 when the second tripping accessory 52 is fixably secured to the tripping shaft 30. Snap protrusions 84 extend from the engaging orifice in a direction substantially perpendicular to a diameter of the engaging orifice 80. Snap protrusions 84 include a protrusion from each of the circular portions 81 of the engaging orifice 80. Thus, the snap protrusions 84 are disposed on opposite sides of the engaging orifice 80. Snap protrusions 84 include a detent 85 at the end of each protrusion. The detent 85 engages the second groove 74. Second flat surfaces 72 in contact with flat portions 82 prevent a rotation of the second tripping accessory 52 with respect to the surface of the tripping shaft 30. Second tripping accessory 52 also includes an operating surface 90. Operating surface 90 is disposed substantially perpendicular to the diameter of the engaging orifice 80. Operating surface 90 includes two portions substantially planar in shape with a bent portion 92 separating the two portions substantially planar in shape. Operating surface 90 is in communication with the undervoltage coil 16.

Figure 9:
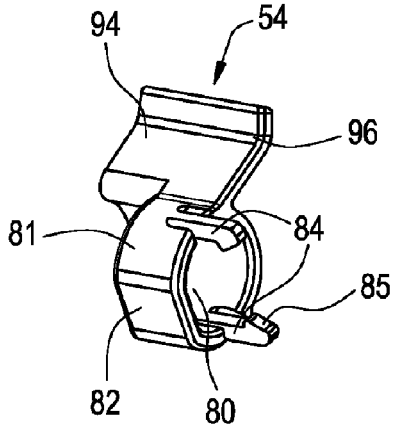
FIG. 9 is a perspective view of a third tripping accessory from an exemplary embodiment.

FIG. 9 shows a third tripping accessory 54 in an exemplary embodiment. Third tripping accessory 54 includes an engaging orifice 80. Engaging orifice 80 is a tubular cuff formed to match a shape of the tripping shaft 30 at the raised portion 64. Thus, engaging orifice 80 includes a substantially circular portion 81 and also includes a flat portion 82. Flat portion 82 is disposed on the engaging orifice 80 to contact third flat surface 76 when the third tripping accessory 54 is fixably secured to the tripping shaft 30. Snap protrusions 84 extend from the engaging orifice in a direction substantially perpendicular to a diameter of the engaging orifice 80. Snap protrusions 84 include a protrusion from opposite sides of the circular portion 81 of the engaging orifice 80. Thus, the snap protrusions 84 are disposed on opposite sides of the engaging orifice 80. Snap protrusions 84 include a detent 85 at the end of each protrusion. The detent 85 engages the third groove 78. Third flat surface 76 in contact with flat portion 82 prevents a rotation of the third tripping accessory 54 with respect to the surface of the tripping shaft 30. Third tripping accessory 54 also includes a contact surface 94. Contact surface 94 is disposed such that it extends substantially tangentially to a radius of the engaging orifice 80. Contact surface 94 includes two portions substantially planar in shape with a bend 96 separating the two portions substantially planar in shape. Contact surface 94 is in communication with the trip free assembly (not shown). The trip free assembly functions to prevent closing the main contact assembly following a tripping of the circuit breaker 10 until the circuit breaker 10 has been reset if the trip occurred as a result of a signal from the trip coil (not shown).

Figure 10:
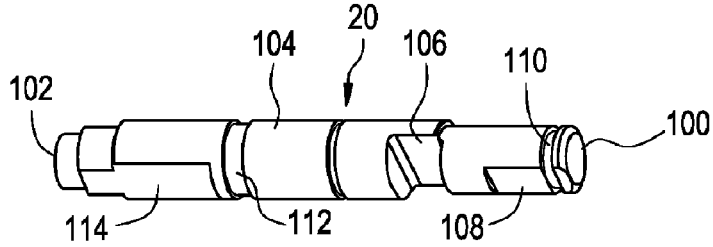
FIG. 10 is a perspective view of a closing shaft from an exemplary embodiment.

FIG. 10 shows the closing shaft 20 in an exemplary embodiment. The closing shaft 20 is substantially cylindrical in shape. Although the closing shaft 20 of the exemplary embodiment shown is substantially cylindrical, other shapes are also contemplated. Closing shaft 20 includes a first end 100 and a second end 102. A diameter of the closing shaft 20 is substantially constant near both first and second ends 100 and 102. Near a center of the closing shaft 20 an elevated portion 104 has a larger diameter than the diameter at first and second ends 100 and 102. Elevated portion 104 includes a notch 106 that connects to mechanical linkages 40 to act as a latching force on the closing springs. First end 100 has a first flat surfaces 108 disposed on opposing sides of the closing shaft 20. A cross section of the closing shaft 20 taken at the first flat surfaces 108 is identical to that shown in FIG. 5. There is also a first groove 110 disposed near the first end 100. First groove 110 extends over a circumference of the closing shaft 20. A second groove 112 is disposed on the elevated portion 104 near a middle of the closing shaft 20. Second groove 112 extends over the circumference of the closing shaft 20. A second flat surface 114 extends from near the second groove 112 to near the second end 102. A cross section of the closing shaft 20 taken at the second flat surface 114 is identical to that shown in FIG. 6. Second flat surface 114 forms a plane substantially parallel to a plane formed by first flat surfaces 108. First and second flat surfaces 108 and 114 and first and second grooves 110 and 112 are formed by machining of the closing shaft 20.

Figure 11:
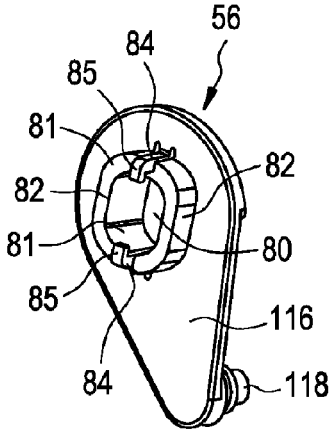
FIG. 11 is a perspective view of a first closing accessory from an exemplary embodiment.

FIG. 11 shows a view of the first closing accessory 56 in an exemplary embodiment. First closing accessory 56 includes an engaging orifice 80. Engaging orifice 80 is a tubular cuff formed to match a shape of the closing shaft 20 at the first end 100. Thus, engaging orifice 80 includes substantially circular portions 81 and also includes flat portions 82. Circular portions 81 are disposed on opposing sides of the engaging orifice 80. Flat portions 82 are also disposed on opposing sides of the engaging orifice 80 to contact first flat surfaces 108 when the first closing accessory 56 is fixably secured to the closing shaft 20. Snap protrusions 84 extend from the engaging orifice in a direction substantially perpendicular to a diameter of the engaging orifice 80. Snap protrusions 84 include one protrusion from each of the circular portions 81 of the engaging orifice 80. Thus, the snap protrusions 84 are disposed on opposite sides of the engaging orifice 80. Snap protrusions 84 include a detent 85 at the end of each protrusion. The detent 85 engages the first groove 110. First flat surfaces 108 in contact with flat portions 82 prevent a rotation of the first closing accessory 56 with respect to the surface of the closing shaft 20. First closing accessory 56 also includes a planar surface 116. Planar surface 116 is disposed substantially parallel to the diameter of the engaging orifice 80. A nipple 118 extends from the planar surface 116 to communicate with the trip free assembly and ensure closing shaft 20 returns to its original position when undervoltage coil 16 actuates.

Figure 12:
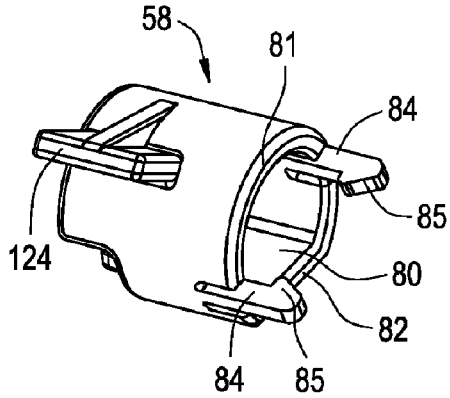
FIG. 12 is a perspective view of a second closing accessory from an exemplary embodiment.

FIG. 12 shows a view of the second closing accessory 58 in an exemplary embodiment. Second closing accessory 58 includes an engaging orifice 80. Engaging orifice 80 is a tubular cuff formed to match a shape of the closing shaft 20 at the elevated portion 104. Thus, engaging orifice 80 includes a substantially circular portion 81 and also includes a flat portion 82. Flat portion 82 is disposed on the engaging orifice 80 to contact second flat surface 120 when the second closing accessory 58 is fixably secured to the closing shaft 20. Snap protrusions 84 extend from the engaging orifice in a direction substantially perpendicular to a diameter of the engaging orifice 80. Snap protrusions 84 include a protrusion from opposite sides of the circular portion 81 of the engaging orifice 80. Snap protrusions 84 include a detent 85 at the end of each protrusion. The detent 85 engages the second groove 112. Second flat surface 120 in contact with flat portion 82 prevents a rotation of the second closing accessory 58 with respect to the surface of the closing shaft 20. Second closing accessory 58 also includes a contact surface 124. Contact surface 124 is disposed such that it extends substantially radially from a center of the engaging orifice 80. Contact surface 124 is in communication with the trip free assembly.

Figure 13:
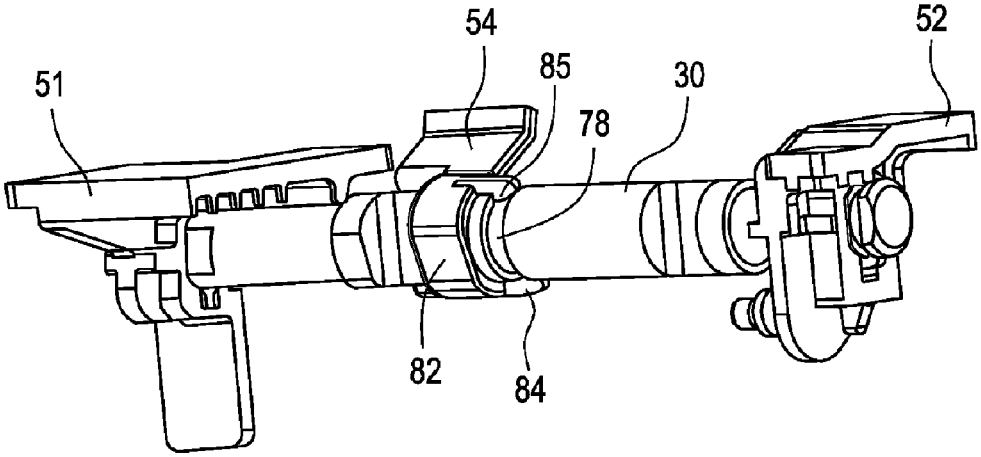
FIG. 13 shows a perspective view of an exemplary embodiment in which the tripping shaft is fully accessorized.

FIG. 13 shows an exemplary embodiment in which the tripping shaft 30 is fully accessorized. Third tripping accessory 54 is installed so that flat portion 82 slides over third flat surface 76 until detent 85 of snapping protrusions 84 extends into the third groove 78. The snapping protrusions 84 in combination with the detent 85 ensure no longitudinal movement of the third tripping accessory 54. First tripping accessory 51 is installed so that flat portions 82 slide over first flat surfaces 68 until detent 85 of snapping protrusions 84 extends into the first groove 70. The snapping protrusions 84 in combination with the detent 85 ensure no longitudinal movement of the first tripping accessory 51. Second tripping accessory 52 is installed so that flat portions 82 slide over second flat surfaces 72 until detent 85 of snapping protrusions 84 extends into the second groove 74. The snapping protrusions 84 in combination with the detent 85 ensure no longitudinal movement of the second tripping accessory 52. In an exemplary embodiment, the tripping shaft 30 is accessorized at an assembly line, however, other methods of assembly are also envisioned.

Figure 14:
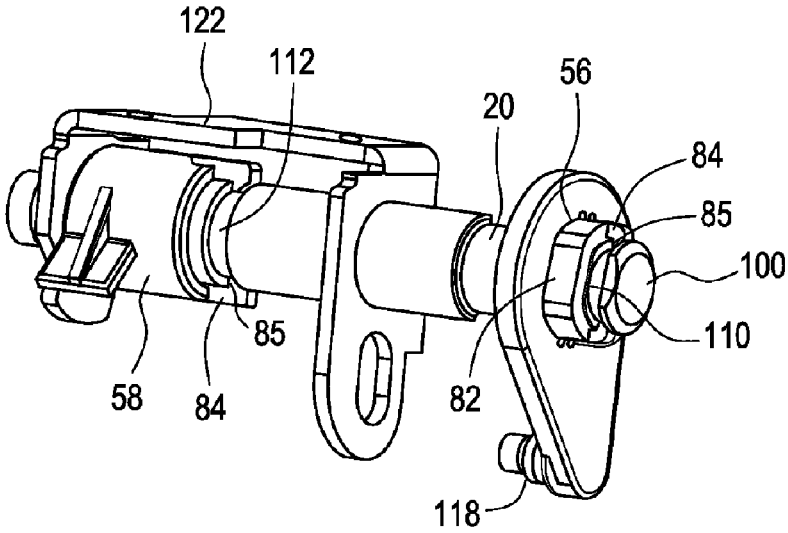
FIG. 14 shows a perspective view of an exemplary embodiment in which the closing shaft is fully accessorized.

FIG. 14 shows an exemplary embodiment in which the closing shaft 20 is fully accessorized. Second closing accessory 58 is installed so that flat portion 82 slides over second flat surface 114 until detent 85 of snapping protrusions 84 extends into the second groove 112. The snapping protrusions 84 in combination with the detent 85 ensure no longitudinal movement of the second closing accessory 58. First closing accessory 56 is installed so that flat portions 82 slide over first flat surfaces 108 until detent 85 of snapping protrusions 84 extends into the first groove 110. The snapping protrusions 84 in combination with the detent 85 ensure no longitudinal movement of the first closing accessory 56. A closing paddle 122 is disposed at the closing shaft 20 from a middle portion of the closing shaft 20 to the second end 102. Closing paddle 122 forms a bridge over second closing accessory 58. Closing paddle 122 is in communication with closing coil 14. When closing coil 14 actuates a linear force is exerted on closing paddle 122 and translated into rotational force on closing shaft 20. Rotation of the closing shaft 20 causes mechanical linkages 40 to release energy in the closing springs to close the main contact assembly. In an exemplary embodiment, the closing shaft 20 is accessorized at an assembly line, however, other methods of assembly are also envisioned.

In addition, while the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An accessory for providing mechanical communication between a rotatable latching shaft and an actuation device of an electrical circuit breaker, the accessory comprising:

a lever, said lever includes an engagement orifice, said engagement orifice receptive to the rotatable latching shaft;

a working surface, said working surface in mechanical communication with the actuation device; and a snap fitting, said snap fitting securely mated with the rotatable latching shaft;

wherein said snap fitting comprises diametrically opposed protrusions, each protrusion of said diametrically opposed protrusions having a detent.

2. The accessory of claim 1, wherein the accessory is made of molded plastic.

3. The accessory of claim 1, wherein said engagement orifice is formed to have a shape that matches a shape of the rotatable latching shaft to which the lever is fixedly secured.

4. An accessorized shaft in mechanical communication with an actuation device of a circuit breaker comprising:

a rotatable latching shaft; and an accessory comprising:

a lever, said lever includes an engagement orifice, said engagement orifice receptive to said rotatable latching shaft;

a working surface, said working surface in mechanical communication with the actuation device; and a snap fitting, said snap fitting securely mated with said rotatable latching shaft;

wherein said rotatable latching shaft comprises a substantially cylindrically shaped rod, and a shaped portion of said substantially cylindrically shaped rod adapted to receive said accessory;

wherein said shaped portion comprises at least one of a flat surface disposed at a side surface of said rotatable latching shaft, and a groove disposed around a circumference of said rotatable latching shaft;

wherein said engagement orifice has a shape which mates securely with said flat surface, said shape prevents a slipping of said engagement orifice with respect to said flat surface of said rotatable latching shaft.

5. The accessorized shaft of claim 4, wherein said accessory is made of molded plastic.

6. The accessorized shaft of claim 4, wherein said snap fitting comprises:

a pair of protrusions extending from said accessory along said side surface of said rotatable latching shaft;

a detent disposed on an end portion of each protrusion of said pair of protrusions, wherein said detent securely mates with said groove.

7. The accessorized shaft of claim 4, wherein the shaft mechanism further comprises a plurality of accessories.

8. The accessorized shaft of clam 7, wherein the shaft mechanism further comprises a plurality of shaped portions, each one of said plurality of shaped portions corresponding to each one of said plurality of accessories.

9. The accessorized shaft of claim 4, wherein said actuation device comprises at least one of:

an under voltage trip coil;

a closing coil; and a shunt trip coil.

10. The accessorized shaft of claim 4, wherein said rotatable latching shaft comprises at least one of a closing shaft and a tripping shaft.

11. A mechanism that operates a main contact assembly of a circuit breaker via mechanical communication between the mechanism and a spring, said mechanism comprising:

an actuation device;

a rotatable latching shaft;

a mechanical linkage, said mechanical linkage providing the mechanical communication between said rotatable latching shaft and the spring; and an accessory comprising:

a lever, said lever includes an engagement orifice, said engagement orifice receiving said rotatable latching shaft;

a working surface, said working surface in mechanical communication with said actuation device; and a snap fitting, said snap fitting securely mated with said rotatable latching shaft;

wherein said rotatable latching shaft comprises a substantially cylindrically shaped rod, and a shaped portion of said substantially cylindrically shaped rod adapted to receive said accessory;

wherein said shaped portion comprises at least one of a flat surface disposed on a side surface of said rotatable latching shaft, and a groove disposed around a circumference of said rotatable latching shaft;

wherein said snap fitting comprises:

a pair of protrusions extending from said accessory along said side surface of said rotatable latching shaft;

a detent disposed on a end portion of each protrusion of said pair of protrusions, wherein said detent is adapted to mate securely with said groove.

12. The mechanism of claim 11, wherein said actuation device comprises at least one of:

an under voltage trip coil;

a shunt trip coil; and a closing coil.

13. The mechanism of claim 11, wherein said accessory is made of molded plastic.

14. The mechanism of claim 11, wherein said engagement orifice has a shape which mates securely with said flat surface, said shape prevents a slipping of said engagement orifice with respect to said flat surface of said rotatable latching shaft.

* * * * *

UNITED STATES PATENT AND TRADEMARK OFFICE

CERTIFICATE OF CORRECTION

PATENT NO. : 7,154,361 B1
APPLICATION NO. : 10/908246
DATED : December 26, 2006
INVENTOR(S) : Triplicane Gopikrishnan It is certified that error appears in the above-identified patent and that said Letters Patent is hereby corrected as shown below:

Column 7:
Line 43, after "surface", delete "120" and insert therefor --114--.

Signed and Sealed this

Tenth Day of April, 2007

JON W. DUDAS
*Director of the United States Patent and Trademark Office*